United States Patent [19]

Janhonen

[11] Patent Number: 4,972,653

[45] Date of Patent: Nov. 27, 1990

[54] APPARATUS FOR CLOSING A PACKAGE AROUND AN ARTICLE TO BE PACKAGED

[75] Inventor: Veikko I. Janhonen, Helsinki, Finland

[73] Assignee: Pussikeskus Oy, Helsinki, Finland

[21] Appl. No.: 447,660

[22] Filed: Dec. 8, 1989

[30] Foreign Application Priority Data

Dec. 16, 1988 [FI] Finland ..... 885852

[51] Int. Cl.[5] ..... B65B 11/18; B65B 13/20; B65B 59/00

[52] U.S. Cl. ..... 53/504; 53/218; 53/528

[58] Field of Search ..... 53/504, 503, 493, 66, 53/64, 218, 209, 203, 176, 461, 449, 528

[56] References Cited

U.S. PATENT DOCUMENTS

| | | | |
|---|---|---|---|
| 2,050,714 | 8/1936 | Malocsay | 53/176 |
| 2,802,321 | 8/1957 | Abbott | 53/176 X |
| 3,237,373 | 3/1966 | Lewis | 53/218 X |
| 4,449,349 | 5/1984 | Roth | 53/504 X |
| 4,757,666 | 7/1988 | Janhonen | 53/528 |
| 4,905,457 | 3/1990 | Bene | 53/504 |

*Primary Examiner*—James F. Coan
*Attorney, Agent, or Firm*—Price, Heneveld, Cooper, DeWitt & Litton

[57] ABSTRACT

An apparatus for closing a package around an article to be packaged by folding one or a plurality of closing flaps (3, 4) around the open side of a package. The apparatus comprises a conveyor track (13), first folding means (32) which are movable crosswise of the conveyor track, holder and pusher means (22) mounted below folding means (32) and movable crosswise of the conveyor track, a first conveyor track section followed by a second conveyor track section (13), the latter being vertically liftable and lowerable, and press means (8, 18) mounted above the second track section and vertically liftable and lowerable. Said folding means (32) are adapted to be movable together with holder and pusher means (22) and, in addition, relative to holder and pusher means (22). Above the first conveyor track section are means for positioning and measuring of the width of an arriving package. The folding means (32) as well as holder and pusher means (22) are adapted to be advanced to the initial folding position on the basis of the measured width. Along one side of the second track section (13) there is a second folding means (7) defining a vertically adjustable gap through which said (22) force a package while the first folding means holder and pusher means (32) are bearing against the top surface of a package. The closed package is carried away from the apparatus between conveyor belts (8, 9), the adhesive having time to set while a second package can already be closed and the width of a third one can be measured.

11 Claims, 3 Drawing Sheets

APPARATUS FOR CLOSING A PACKAGE AROUND AN ARTICLE TO BE PACKAGED

The present invention relates to an apparatus for closing a package around an article to be packaged by folding one or a plurality of closing flaps around the open side of a package, said apparatus comprising a conveyor track, first folding means which are movable by means of a power unit crosswise of the conveyor track, holder and pusher means mounted below the folding means and movable by means of a power unit crosswise of the conveyor track, a first conveyor section followed by a second conveyor section, the latter being vertically liftable and lowerable by means of power units, and press means above the second track section which are vertically liftable and lowerable by means of power units, said folding means being adapted to be movable together with the holder and pusher means and, in addition, relative to the holder and pusher means.

This type of apparatus is known from the Applicants' U.S. Patent publication No. 4.757.666. An object of this invention is to further develop that apparatus for substantially increasing its output, in other words it is possible to run through the apparatus per time unit a substantially larger number of packages to be closed than before.

This object is achieved by the invention on the basis of the characterizing features set forth in the annexed claims.

One embodiment of the invention will now be described in more detail with reference made to the accompanying drawings, in which FIG. 1 shows a package in a package closing station at a certain stage of closing, as well as the most relevant elements for effecting the closure of a package;

Figure 1:
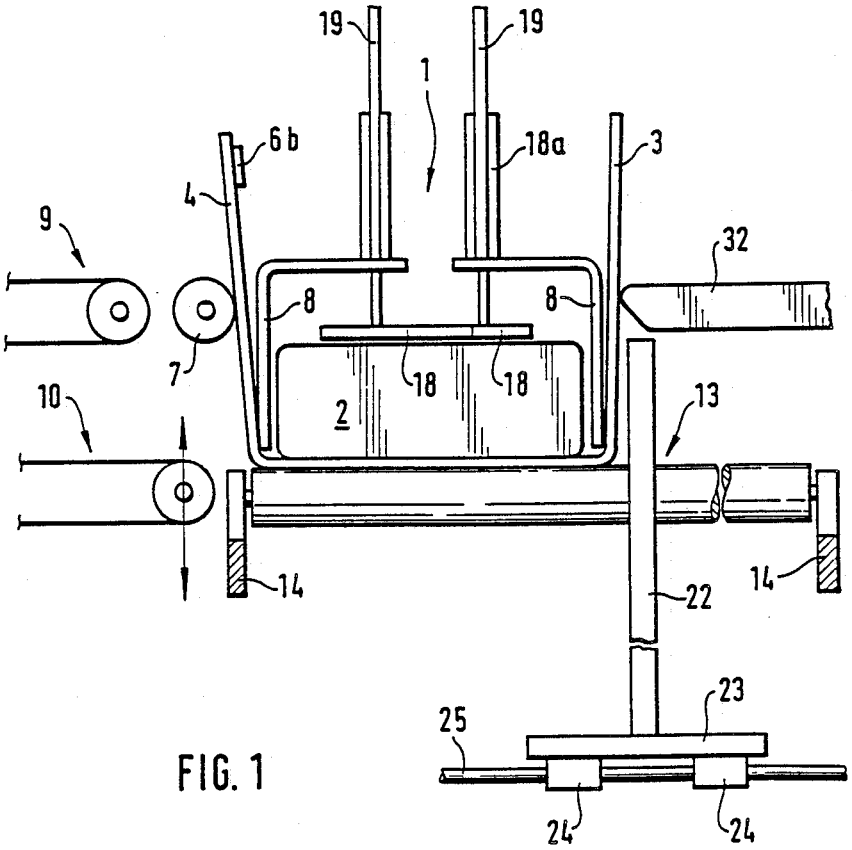

In FIG. 1, reference numeral 1 indicates a package to be closed, comprising an article portion 2 wrapped in a protective wrapping and around which the prodruding ends 3 and 4 of a protective cardboard are to be folded. The question may also be about another type of package, including one or two closing flaps 3 and/or 4 which is or are to be folded around the open side of a package.

The structure and operation of the apparatus is as follows. A package blank with its flaps 3 and 3 in horizontal position is supplied onto a conveyor 5, said flaps 3 and 4 extending beyond the side edges of conveyor 5. As the leading edge of package blank 1 comes into the alignment with an electric eye 12, the result is the actuation of positioning and width-measuring means 46–54. The package blank stops as its leading edge collides with arrester pins 55. Cylinders 56 swing plates 46 and 37 to a vertical position. A clamping bar 49 of plate 47 is fixed in a stationary position on slide bars 50. A clamping bar 48 of plate 46 is movable along slide bars 50 by means of a cylinder 51 whose end is provided with a clamping bar 52 that can be locked at a desired position on slide bars 50. The cylinder 51 is used to push plate 46 until it collides with an article portion 2 of a package and urges it against plate 47, the latter being provided with a sensor (not shown) for interrupting the push of cylinder 51. The distance between plates 46 and 47 matches now the width of article portion 2. During the displacement of plate 46, an electric eye 53 carried therealong has issued a number of pulses proportional to the covered distance for indicating the width of packaged article 2 retained between plates 46 and 47. In order to deliver the pulses, a framework 21 is provided with an array of lines or holes 54.

The press means provided by vertical plates 8 are connected by piston rods 19 to cylinders 20, the left-hand side one being fixedly mounted on framework 21 and the righthand side cylinder 20 is connected with a sliding base 41mounted by slide bearings 42 on slide bars 43. A chain 40 engaging with said base 41 moves the right-hand side plate 8 in a manner that the distance between plates 8 slightly exceeds the measured width of article portion 2.

The chain 40 is passed over idler wheels 39 to a sprocket lying on the same axis as a sprocket 38. The sprocket 38 is coupled by means of an endless chain 36 with base members 35 and 37 of cylinders 44 and 26. Slide bars 25 are fixed at one end thereof to the base member 37 of cylinder 26 and the other end of slide bars 25 has connected therewith the piston rod 11*a* of a cylinder 11.

The holder and pusher means provided by vertical, parallel rods 22 are fixed to a sliding base 23 which is mounted on slide bars 25 by means of slide bearings 24. The piston rod of cylinder 26 is fixed to said base 23. Immediately above said holder and pusher means 22 are horizontal folding means 32 having their base ends fixed to a sliding base 31 which is mounted on slide bars 34 by means of slide bearings 33. The piston rod of cylinder 44 is fixed to said base 31.

The rollers of conveyor section 13 are journalled to side plates 14 provided with recesses at the upper edge thereof for accomodating folding means 32 between the rollers, whereby the package blank 1 can be advanced onto track section 13 to lie on top of folding means 32. The track section 13 can be pressed down by means of press elements 8, 88, 19, 20 and picked up to the level of track section 5 by means of a piston-cylinder unit 16, 17. The track section 13 can be locked at any level by means of electromagnetic braking devices 45.

The horizontal press plates 18 overlapping each other in a finger-like fashion at their comb-like rims are connected with press plates 8 by means of cylinders 18*a*.

Alongside track section 13, the framework 21 has journaled thereto aroll cylinder 7 at such a level that the bottom surface of roll 7 is flush with the horizontal bottom surfaces of folding means 32. The end of a conveyor belt 10 lies below roll 7 and travels in vertical direction along with the movements of track section 13 in a manner that the top side of the end of belt 10 is flush or level with the top side of the rollers of presseddown track section 13. The end of upper conveyor belt 9, which is adjacent to roll 7, is in a fixed position while the end of belt 9 distal from the apparatus is vertically adjustable, whereby the conveying gap between belts 9 and 10 is adjustable as a whole.

Figure 2:
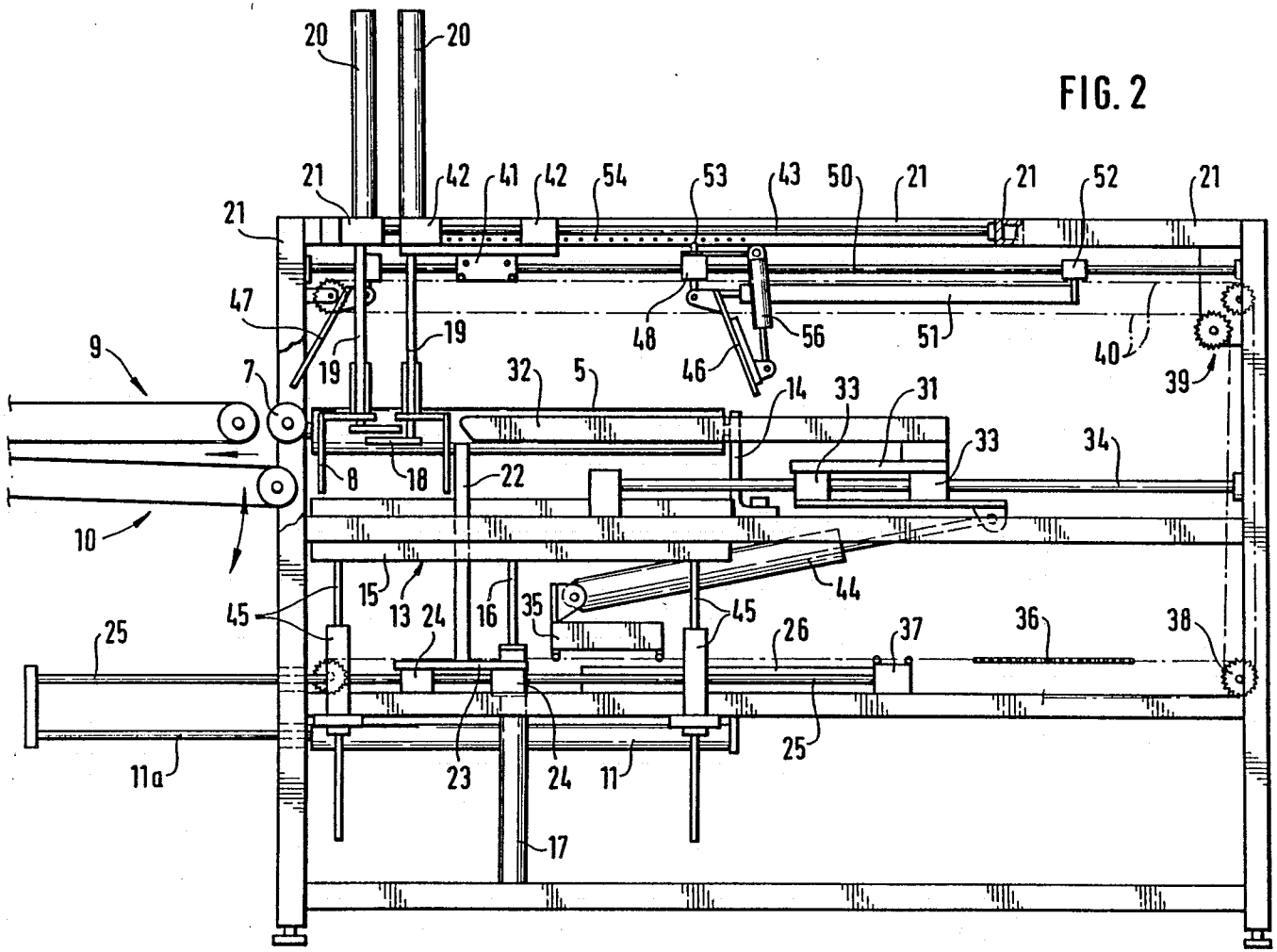
FIG. 2 shows the apparatus in a side view.
Figure 3:
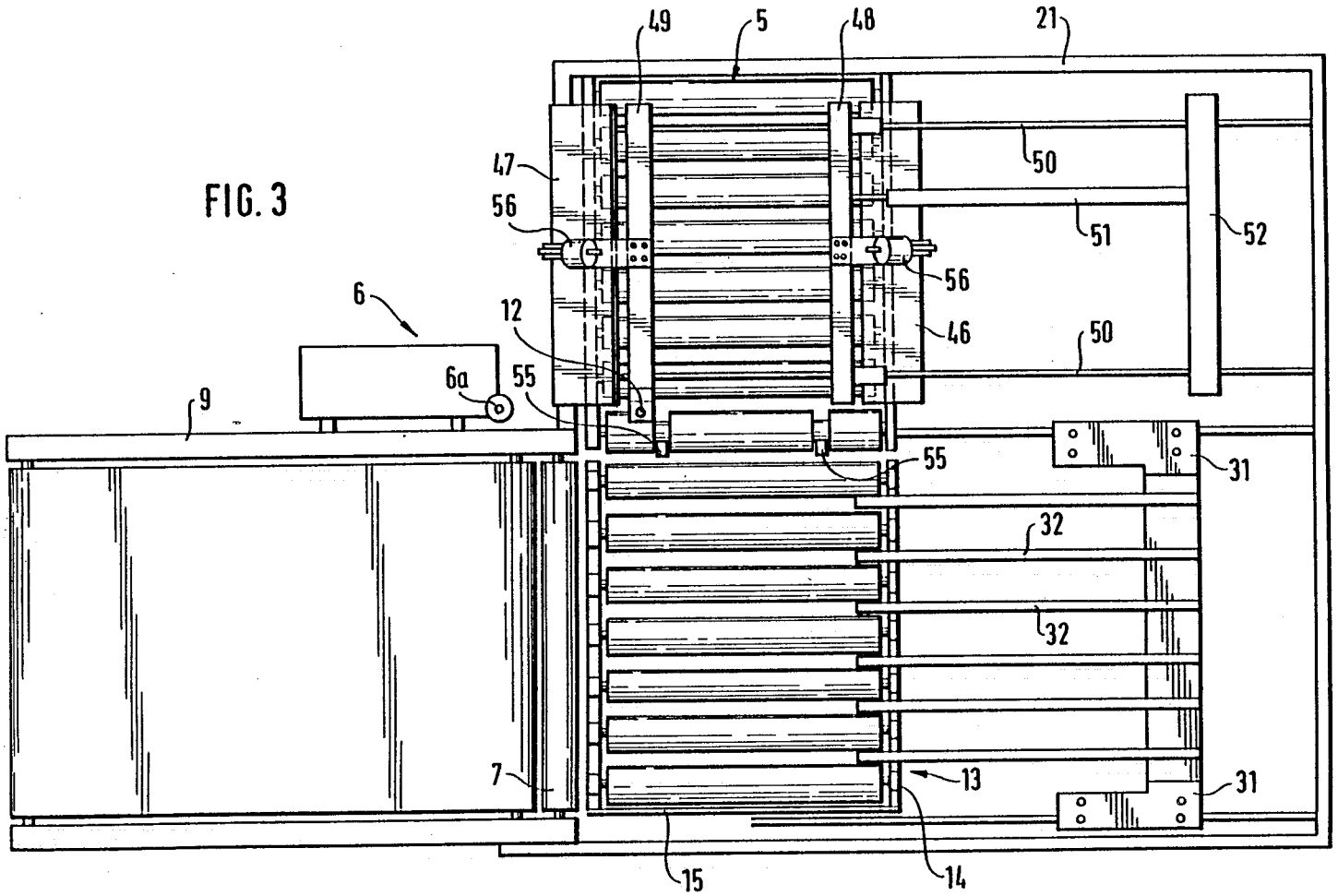
FIG. 3 shows the apparatus in a plan view.

In the initial situation, the piston rod of cylinder 26 is retracted and the piston rod of cylinder 44 is extended, whereby holder and pusher means 22 are located below the ends of folding means 32. When the width of the article portion 2 of a package mounted on track section 5 has been measured, the piston rod of cylinder 11 is extended by pushing the sliding bases 23, 31 and 41 to left in FIG. 2 until means 22 and 32 as well as the right-hand side plate 8 come to a position at a suitable distance from roll 7 and left-hand side plate 8. Now, the distance between plates 8 slightly exceeds the width of article portion 2 and the distance of means 22 and 32 from roll 7 is such that plates 8 are accommodated therebetween. Plates 8 and 18 are in uplifted position and track section 13 is in uplifted position, said folding means 32 being located between the rolls of track section 13.

The limiter pins 55 are lowered for advancing package blank 1 from track section 5 onto track section 13. During the transfer, the adhesive nozzle 6*a* of a hotsetting adhesive station 6 is used to spray an adhesive layer 6*b* onto the surface of flap 4, which is subsequently pressed into contact with the outer surface of flap 3. After the package blank is advanced onto track section 13 and stopped against limiter wall 15, the press plates 8, 18 are forced down. The press plates 8, 18 are also used to force down track section 13, said flaps 3 and 4 being folded upwards as forced by roll 7 and folding means 32. Pressing down is continued until the top surface of article portion 2 reaches the level below the bottom surfaces of roll 7 and folding means 32. The necessary distance can be measured e.g. by the traveling distance of plates 18 with respect to plates 8 or by means of an electric eye.

The track section 13 is locked by means of devices 45 in a lower position and press Plates 8, 18 are lifted up. By retracting the piston rod of cylinder 44 said folding means 32 are forced on top of a package, flap 3 folding over the top side of a package. Thereafter, the piston rod of cylinder 26 is extended, whereby the base 23 and its associated holder and pusher means 22 travel to the left and, thus, urge a package under roll 7 into a gap between conveyor belts 9 and 10. This forces flap 4 also to fold against the top surface of a package. During the travel between belts 9 and 10, the flaps 3 and 4 of a package are pressed against each other for a period sufficiently long for the adhesive 6*b* to set. Thus, the setting time required by the adhesive does not limit the capacity of the apparatus. As soon as the package has arrived between belts 9 and 10, the track section 13 can be picked up and a new package supplied onto the conveyor track section 13. As soon as the track section 5 is unloaded, it is able to receive a new package blank for positioning and measuring of width. Thus, the positioning and width measuring occurs simultaneously with the folding of flaps 3 and 4 on track section 13. On the basis of the effected width measuring, said folding means 32 and holder and pusher means 22 can be preset in the initial folding position at the same time as the package advances onto track section 13. This serves also to substantially reduce the time that a package must spend on track section 13, which is the actual folding station. Thus, the production capacity of the apparatus is substantially increased with respect to a similar type of apparatus disclosed in U.S. Patent publication 4.757.666.

An apparatus of the invention can also be used for closing packages which only have one open side or mouth to be closed with one foldable closing flap. In this case, the folding means 32 need not perform any folding but to support the package from above as holder and pusher means 22 are forcing the package into a gap between roll 7 and conveyor belt 10. As soon as the edge of a package is under roll 7, the return action of folding means 32 can be initiated. This applies to both types of packages.

I claim:

1. An apparatus for closing a package around an article to be packaged by folding one or a plurality of closing flaps (3, 4) around the open side of a package, said apparatus comprising a convertor track (5, 13), first folding means (32) movable by means of a power unit (44) crosswise of the conveyor track, holder and pusher means (22) mounted below said folding means (32) and movable by means of a power unit (11, 26) crosswise of the conveyor track, a first conveyor track section (5) followed by a second conveyor track section (13), the latter being vertically liftable and lowerable by-means of power units (17, 20), and press means (8, 18) mounted above the second track section and vertically liftable and lowerable by means of power units (19, 20), said folding means (32) being adapted to be movable together with holder and pusher means (22) and, in addition, relative to holder and pusher means (22), characterized in that above said first conveyor track section (5) are arranged elements (46–54) for the positioning and measuring of the width of an arriving package, that said folding means (32) as well as holder and pusher means (22) are adapted to be advanced to the initial folding position on the basis of the measured width, and that along one side of second track section (13) there is a second folding means (7) which defines a vertically adjustable gap through which said holder and pusher means (22) force a package while the first folding means (32) bear against the top surface of a package.

2. An apparatus as set forth in claim 1, characterized in that said second folding means (7) comprises a roll having its lower surface substantially at the same level as the horizontal bottom surfaces of said first folding means (32).

3. An apparatus as set forth in claim 1, characterized in that said gap is defined from below by the end of a conveyor belt (10), which is vertically movable together with the second conveyor track section (13).

4. An apparatus as set forth in claim 3, characterized in that above said conveyor belt (10) there is a second conveyor belt (9) having its outer end vertically adjustable.

5. An apparatus as set forth in claim 1, characterized in that the apparatus includes two separate press members (8), which are in the form of a vertical plate and whose mutual spacing is adjustable to match the measured width of a package in a manner that, upon forcing said press memebers (8) against a package to be closed, the vertical plates will be along both sides of an article (2) but between first and second folding means (32 and 7).

6. An apparatus as set forth in claim 1, characterized in that the second conveyor track section (13) is adapted to be forced down by means of press members (8, 18) as the package to be closed is positioned between conveyor track section (13) and press members (8, 18).

7. An apparatus as set forth in claim 1, characterized in that the package positioning and widthmeasuring elements (46–54) include two mutually spaced plates (46 and 47) which can be swung by means of a power unit (56) between an inclined position and a vertical position and one of which is further movable by means of a power unit (51) along horizontal slide bars (50), and that an electric eye (53) carried along by the movable plate (46) is adapted to deliver a number of pulses proportional to the covered distance, said pulses indicating the width of a packaged article (2) retained between plates (46, 47).

8. An apparatus as set forth in claim 6, characterized in that the press members include horizontal plates (18) which are located between vertical plates (8) and which can be forced down by means of their own power units (18*a*) relative to vertical plates (8).

9. An apparatus as set forth in claim 2, characterized in that said gap is defined from below by the end of a conveyor belt (10), which is vertically movable together with the second conveyor track section (13).

10. An apparatus as set forth in claim 9, characterized in that above said conveyor belt (10) there is a second conveyor belt (9) having its outer end vertically adjustable.

11. An apparatus as set forth in claim 5, characterized in that the second conveyor track section (13) is adapted to be forced down by means of press members (8, 18) as the package to be closed is positioned between conveyor track section (13) and press members (8, 18).

* * * * *

UNITED STATES PATENT AND TRADEMARK OFFICE

CERTIFICATE OF CORRECTION

PATENT NO. : 4,972,653

DATED : November 27, 1990

INVENTOR(S) : Veikko I. Janhonen

It is certified that error appears in the above-identified patent and that said Letters Patent is hereby corrected as shown below:

In the Abstract, line 22:
After "said" insert -- holder and pusher means --.

In the Abstract, line 23:
After "means" delete -- holder and pusher means --.

Column 1, line 43:
"prodruding" should be -- protruding --.

Column 1, line 49:
"flaps 3 and 3" should be -- flaps 3 and 4 --.

Column 2, line 10:
"41mounted" should be -- 41 mounted --.

Column 2, line 34:
"accomodating" should be -- accommodating --.

Column 2, line 38:
"88" should be -- 18 --.

Column 2, line 46:
"aroll" should be -- a roll --.

Column 2, line 52:
"presseddown" should be -- pressed-down --.

UNITED STATES PATENT AND TRADEMARK OFFICE

CERTIFICATE OF CORRECTION

PATENT NO. : 4,972,653

DATED : November 27, 1990

INVENTOR(S) : Veikko I. Janhonen

It is certified that error appears in the above-identified patent and that said Letters Patent is hereby corrected as shown below:

Column 4, line 2:
"converter" should be -- conveyor --.
Column 4, line 45:
"memebers" should be -- members --.
Column 4, line 55:
"widthmeasuring" should be -- width-measuring --.

Signed and Sealed this

Fourth Day of August, 1992

*Attest:*

DOUGLAS B. COMER

*Attesting Officer*

*Acting Commissioner of Patents and Trademarks*